US006945070B1

(12) United States Patent
Jablonski et al.

(10) Patent No.: US 6,945,070 B1
(45) Date of Patent: Sep. 20, 2005

(54) ICE COOLED COLD PLATE AND CARBONATOR

(75) Inventors: Thaddeus M. Jablonski, Palatine, IL (US); Andrew J. Tobler, Franklin Park, IL (US)

(73) Assignee: IMI Cornelius Inc., Anoka, MN (US)

( * ) Notice: Subject to any disclaimer, the term of this patent is extended or adjusted under 35 U.S.C. 154(b) by 0 days.

(21) Appl. No.: 10/824,739

(22) Filed: Apr. 15, 2004

(51) Int. Cl.[7] ..... B67D 5/62
(52) U.S. Cl. ..... 62/390; 62/394; 62/398
(58) Field of Search ..... 62/331, 389, 390, 62/393, 394, 396, 398, 400; 222/146.6

(56) References Cited

U.S. PATENT DOCUMENTS 4,781,309 A * 11/1988 Vogel ..... 222/129.1
5,230,448 A * 7/1993 Strohmeyer et al. ..... 222/643
5,392,960 A * 2/1995 Kendt et al. ..... 222/129.1
5,419,461 A * 5/1995 Goulet ..... 22/129.1
5,487,492 A * 1/1996 Goulet ..... 22/129.1
5,524,452 A * 6/1996 Hassell et al. ..... 62/389
6,463,753 B1 * 10/2002 Haskayne ..... 62/389
6,505,758 B2 * 1/2003 Black et al. ..... 222/146.6
6,574,981 B2 * 6/2003 Schroeder ..... 62/306
6,626,005 B2 * 9/2003 Schroeder ..... 62/306
6,761,036 B2 * 7/2004 Teague et al. ..... 62/70

FOREIGN PATENT DOCUMENTS

EP 0585121 A2 * 3/1994
JP 8-119390 A * 5/1996

* cited by examiner

*Primary Examiner*—Mohammad M. Ali
(74) *Attorney, Agent, or Firm*—Pyle & Piontek

(57) ABSTRACT

A beverage cooling system for an ice and beverage dispenser is characterized by a cold plate for mounting a carbonator tank. The cold plate is provided with carbonator tank supports for mounting the carbonator tank in intimate heat exchange contact with the cold plate, with the carbonator tank being mounted sufficiently far away from heat exchange surfaces of the cold plate that it does not interfere with ice contacting the heat exchange surfaces. The arrangement is such that there is substantially no diminution of a surface area of the cold plate that is available to receive ice. At the same time, the carbonator is effectively cooled through direct heat exchange contact with the cold plate.

26 Claims, 4 Drawing Sheets

ICE COOLED COLD PLATE AND CARBONATOR

FIELD OF THE INVENTION

The present invention relates generally to beverage cooling systems, and in particular to cold plates as used in beverage dispensers in combination with internal carbonators.

BACKGROUND OF THE INVENTION

It is known in the beverage dispensing art to use cold plates to provide heat exchange cooling of various drinks. The cold plate itself is cooled by a volume of ice placed in contact with it, and in turn provides for cooling of beverage liquids circulated through tubes embedded in the cold plate. In situations where a cold plate is used in conjunction with a post-mix beverage dispenser, sources of carbonated water and beverage syrup flavoring are connected to the cold plate to be cooled as they are passed through the cold plate. A carbonated drink is then produced when the cooled carbonated water and syrup flavoring constituents are subsequently mixed together and dispensed from a post mix valve.

A carbonator tank is generally used to produce the carbonated water through the mixture therein of water and carbon dioxide gas. A problem concerns placement of the carbonator tank. Locating the carbonator to the exterior of a dispenser is known, but ambient warming of the carbonator and its contents then becomes a problem in terms of dispenser performance and added ice usage. It is known to have an internal carbonator that is placed within the dispenser in heat exchange contact with the cold plate, but such efforts have heretofore added cost and complexity to the dispenser and/or resulted in reducing the amount of cold plate surface area available to contact ice and, therefore, in a reduction in the capacity of the cold plate to cool beverages. Accordingly, it would be very desirable to have an internal carbonator that is cooled by the cold plate without substantially reducing the surface area of the cold plate that is available for heat exchange contact with ice.

OBJECTS OF THE INVENTION

A primary object of the present invention is to provide a cold plate adapted to support a carbonator within a beverage dispenser and in heat exchange contact with the cold plate, wherein the cold plate is configured so that support of the carbonator does not result in a substantial reduction in the surface area of the cold plate that is available for heat exchange contact with ice.

SUMMARY OF THE INVENTION

The present invention is a beverage cooling system that includes a cold plate having a carbonator support structure formed as an integral part thereof. The support structure is designed to receive a carbonator tank in close heat exchange contact therewith. The carbonator is advantageously cylindrical and is held by the cold plate support structure in a substantially horizontal orientation along one edge of the cold plate, which desirably results in essentially no diminution of the surface area of the cold plate that is available to retain ice. At the same time, the carbonator is provided with effective cooling thereof through direct contact with the cold plate.

In accordance with one embodiment of the invention, the beverage cooling system comprises a cold plate for receiving ice. The cold plate has integral support means for supporting a carbonator both in heat exchange relationship with the cold plate and in spaced relationship from the remainder of the cold plate. The arrangement is such that support of the carbonator by the cold plate support means does not result in a substantial reduction in the surface area of the cold plate that is available to receive ice.

In accordance with another embodiment of the invention, the beverage cooling system comprises the combination of a cold plate and a carbonator. The cold plate receives and retains ice on surfaces thereof and includes integral support means having a support surface. The carbonator is supported in heat exchange relationship with and on the support surfaces of the cold plate support means and is held in spaced relationship from the remainder of the cold plate surfaces. The arrangement again is such that support of the carbonator by the cold plate does not result in a substantial reduction in the areas of the cold plate surfaces that are available to receive and retain ice, so that supporting the carbonator with the cold plate does not result in a substantial reduction in the effectiveness of the cold plate in cooling beverages flowed therethrough.

DETAILED DESCRIPTION

Figure 1:
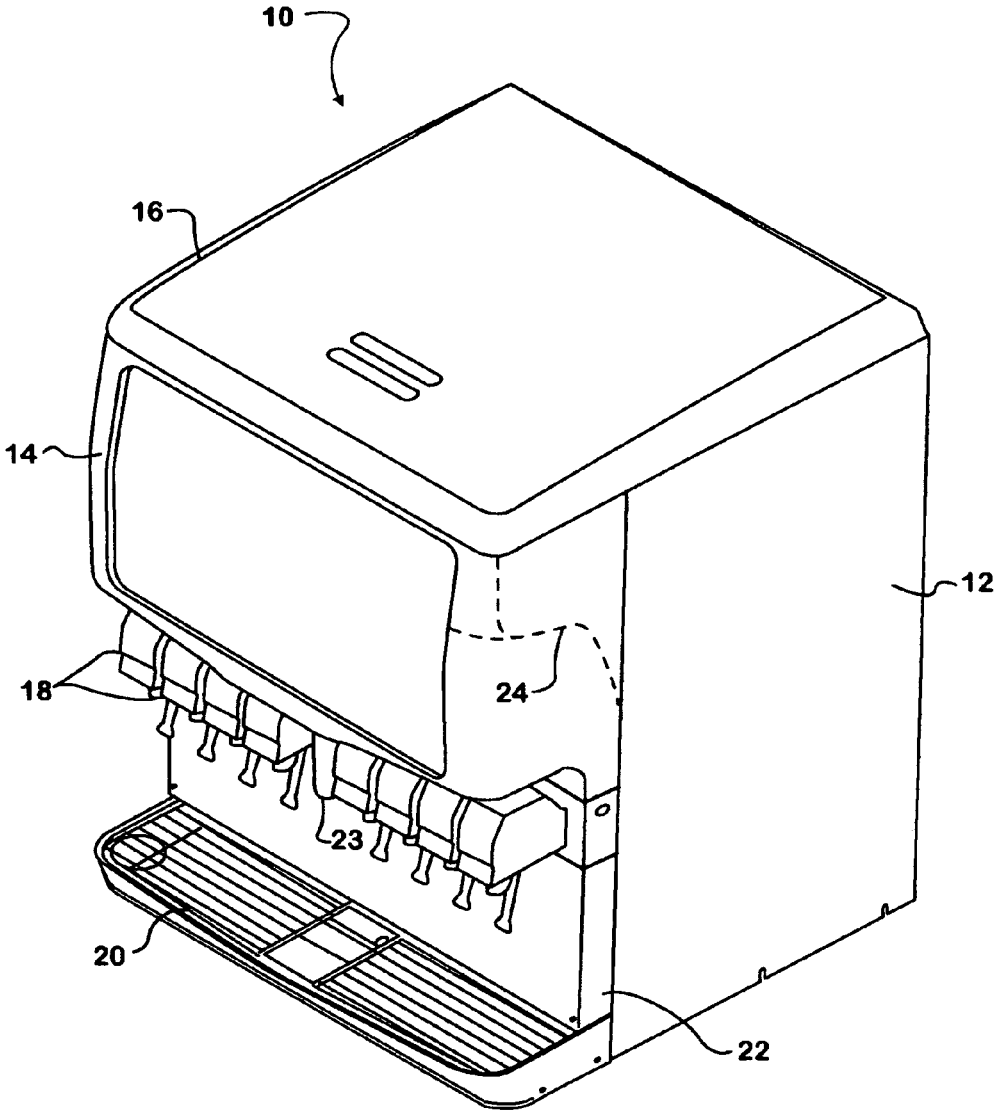
FIG. 1 is a perspective view of a combination beverage and ice dispenser of a type with which a cold plate and carbonator combination of the present invention may be used.
Figure 2:
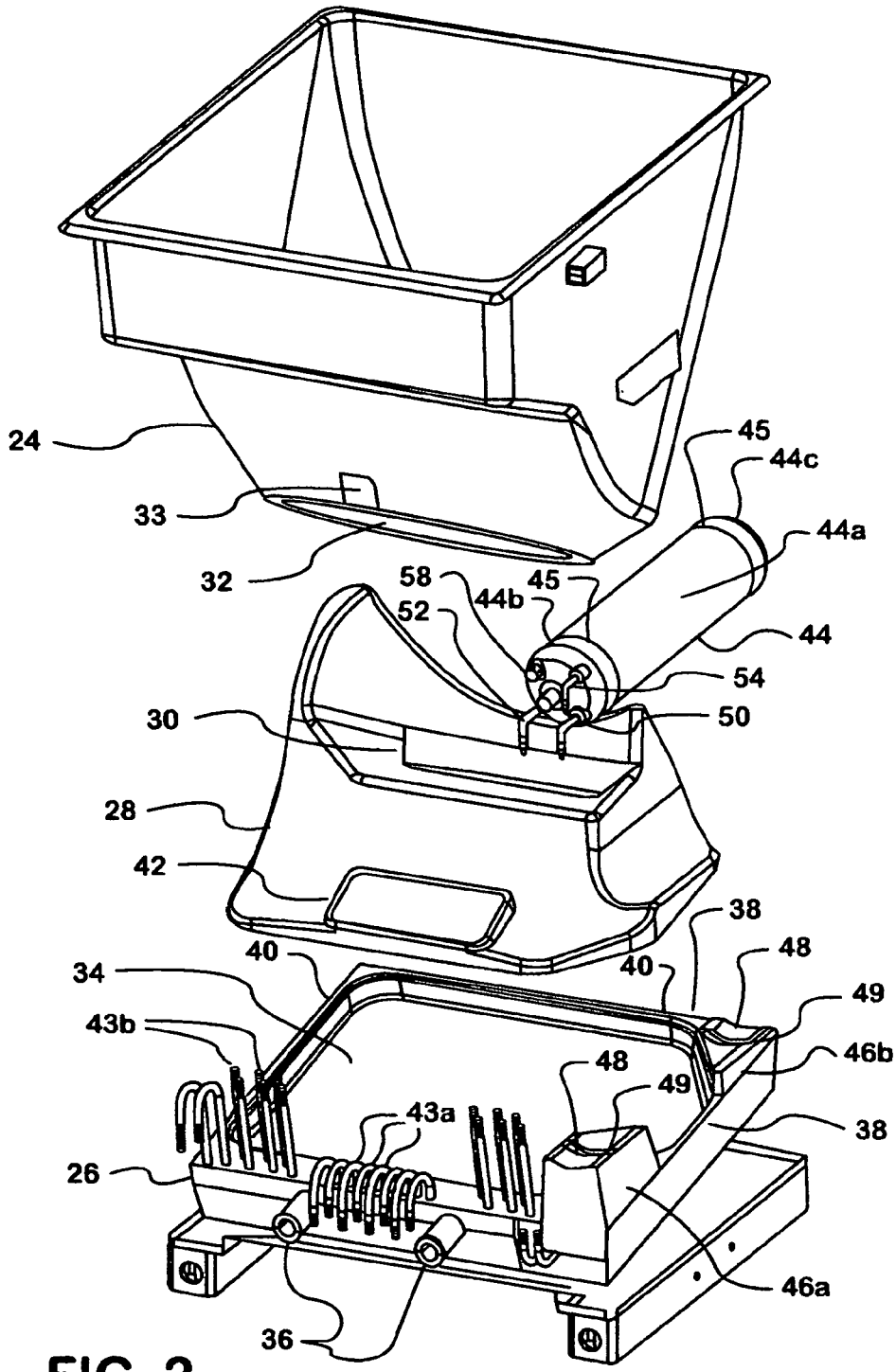
FIG. 2 is an exploded perspective view of the cold plate and carbonator combination in the context of the dispenser of FIG. 1.

The present invention is advantageous for use in the context of a combined beverage and ice dispensing machine of a general type as seen in FIG. 1 and indicated generally at 10. As is customary, the dispenser 10 includes an outer housing 12, a merchandising cover 14 and a removable ice bin cover 16. A plurality of beverage dispensing valves 18 is secured to a front surface of the dispenser above a drip tray 20 and adjacent a splash panel 22. An ice dispensing chute 23 is also secured to the front surface of the dispenser centrally of the valves 18 and above the drip tray 20. As is customary and as seen in FIG. 2, the dispenser 10 has an ice retaining bin 24, a cold plate 26 and a cold plate cover 28. The cover 28 has an ice drop hole 30 that is secured in sealed relationship to a corresponding ice drop hole (not shown) in the bottom of the ice bin 24. The ice bin 24 is formed to have an angled front surface 32 for receiving an agitator motor that drives an agitator (neither shown) that resides within the ice bin 24. The ice bin has an ice outlet opening 33 through which ice to be dispensed exits the bin for flow into, through and out of the chute 23 into a cup.

As is known, the agitator motor rotates the agitator in the ice retaining bin 24 to agitate and mix particles ice retained within the bin to prevent congealing and agglomeration of the ice particles into a mass of ice, to move and direct ice to and out of the bin outlet opening 33 and into the chute 23 for dispensing of the ice, and to maintain the ice particles in discrete free flowing form. Rotation of the agitator also causes some of the ice within the bin 24 to fall through the bin bottom opening and the opening 30 in the cold plate cover 28 onto a generally rectangular heat exchange top surface 34 of the cold plate 26. The cold plate is typically positioned at an angle within the dispenser 10 to facilitate draining of ice melt water from its top surface 34 to and through cold plate drains 36. The cold plate heat exchange top surface 34 is defined within an upstanding perimeter edge 38 of the cold plate 26 and the cover 28 is secured to the cold plate along a perimeter shoulder 40 formed in the perimeter edge 38. The cover 28 encloses the cold plate and defines therewithin a cold plate compartment that resides beneath the ice retaining bin 24 and forms a protected ice retaining space above the cold plate heat exchange top surface 34. The cover is provided with an access hole 42 to facilitate access to the cold plate for cleaning of its drains 36. As is understood, the cold plate 26 includes a plurality of beverage fluid inlets 43*a* and outlets 43*b*.

Figure 3:
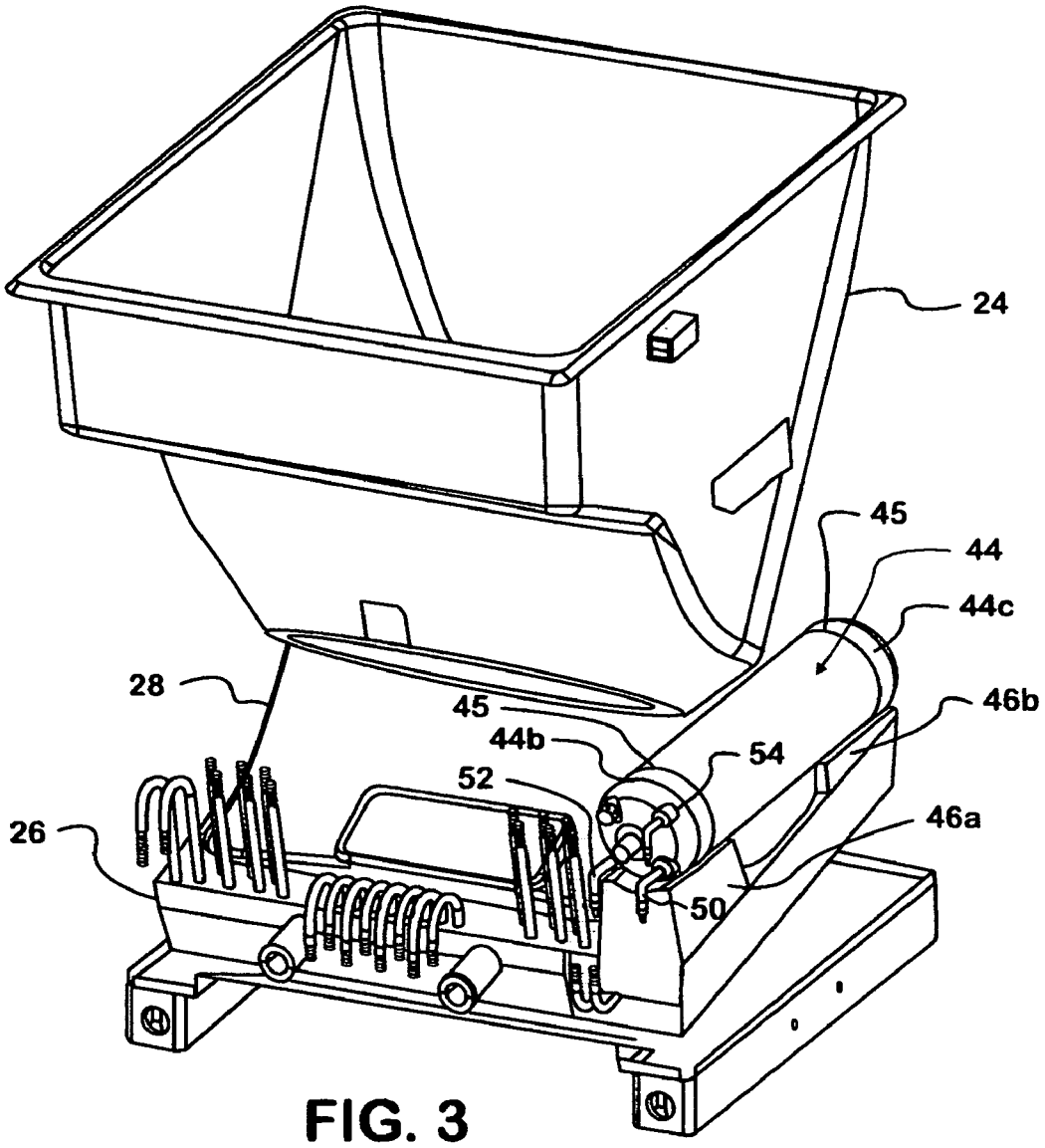
FIG. 3 is an assembled view of the dispenser and cold plate and carbonator combination.
Figure 4:
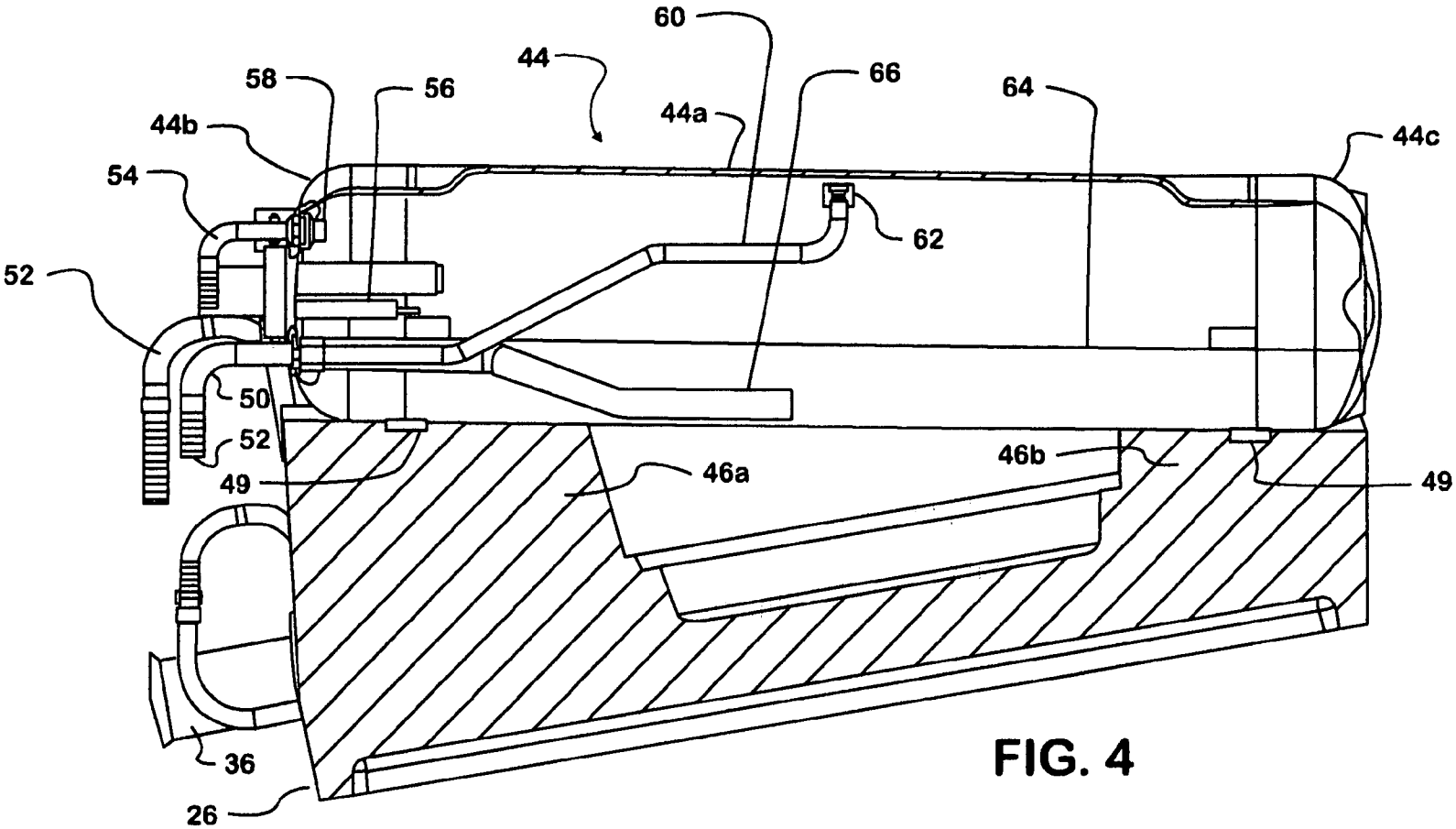
FIG. 4 shows a cross-sectional view side elevation view of the carbonator as supported in heat exchange contact on the cold plate.

The novel configuration of the cold plate 24 that permits heat exchange mounting of a carbonator to the cold plate with essentially no diminution in the surface area of the cold plate that is available to contact, retain and be cooled by ice may be understood by reference to FIGS. 2–4. As seen, a cylindrical carbonator 44 is comprised of a central cylinder 44*a* and two end caps 44*b* and 44*c* secured to opposite ends of the central cylinder at annular seams 45. The cold plate 26 is of a unitary structure and is configured to have forward and rearward carbonator saddles or supports 46*a* and 46*b* that are formed as an integral part of the cold plate and extend vertically upward from front and rear corners of the cold plate above and partially along one side of the perimeter edge 38. Areas of the cold plate supports 46*a* and 46*b* are adapted for heat exchange contact with the carbonator 44 include a concave arcuate heat exchange upper surface 48 of each support and an arcuate recess 49 formed in each heat exchange surface 48. The heat exchange arcuate surfaces 48 are of a radius to be complementary to and match the arcuate profile of the cylindrical convex outer surface of the carbonator tank 44, so that when the carbonator is supported on the surfaces 48 of the supports 46*a* and 46*b*, the seams 45 are received in the arcuate recesses 49 to enable the surfaces 48 to receive the carbonator 44 in intimate direct heat exchange contact. With the carbonator 44 supported on the surfaces 48, the recesses 49 serve to receive and accommodate the annular seams 45, to enable close heat exchange contact between the carbonator and the support surfaces 48. As is known, various spaces to the interior of the dispenser 10 and around the carbonator 44, cold plate 26 and cover 28 are insulated by foamed in place insulating material. In practice of the present invention, the insulating material can serve to hold the carbonator 44 in place, although the insulating material is not shown in order to facilitate a clear description and viewing of the invention.

The carbonator 44 produces carbonated water in a manner known in the art, wherein water and carbon dioxide gas are mixed in intimate contact within a pressurized container. As is conventional, the carbonator 44 has a water inlet 50 for connection to a source of potable water, a carbonated water outlet 52 for providing fluid connection to the valves 18, a carbon dioxide gas inlet 54 for connection to a source of pressurized carbon dioxide gas, a liquid level sensor 56 connected to a control mechanism for controlling delivery of water into the carbonator 44 through the water inlet 50 as a function of the withdrawal of carbonated water through the outlet 52, and a pressure safety valve 58. Internally of the carbonator 44, the water inlet 50 connects to a water tube 60 that is angled to direct water to flow out of an outlet 62 into an upper interior zone of the carbonator that is filled with pressurized carbon dioxide gas and against an upper inner surface of the cylinder 44*a*. The outlet 62 is designed to atomize the water to improve take-up of pressurized carbon dioxide gas into the water within the zone, and thereby to enhance the efficient carbonation of the water. A flat plate 64 extends along and within the carbonator 44 and has a plurality of holes extending therethrough. The flat plate 64 serves to define a relatively quiescent lower area of the carbonator 44 beneath it, so that only carbonated water, as opposed to volumes of gas, is taken up through an outlet tube 66 for flow out of the outlet 52 to the beverage valves 18.

The front carbonator support 46*a* of the cold plate 26 is longer front to back than is the rear carbonator support 46*b*. The front support 46*a* also extends farther vertically above the heat exchange cold plate surface 34 than does the rear support 46*b*, as a result of which the supports 46*a* and 46*b*, when holding the carbonator 44, compensate for the downward angle from rear to front at which the cold plate 26 is positioned to facilitate ice melt water drainage off of its heat exchange surface 34, so that the carbonator 44 is then supported substantially horizontal. The carbonated water within the carbonator 44 therefore resides along the length of the carbonator at a substantially uniform depth and in full contact with the portions of the carbonator that are in contact with the heat exchange surfaces 48 of the cold plate supports 46*a* and 46*b*. The horizontal orientation of the carbonator 44 thus ensures maximum, efficient and improved heat exchange cooling of the carbonated water resulting from the heat exchange contact of the carbonator with both cold plate support surfaces 48. In addition, by virtue of the cold plate saddle supports 48*a* and 48*b* holding the carbonator 44 in substantial horizontal orientation, the height difference within the carbonator between the liquid/gas interface level and the top of the carbonator does not change as much along the length of the carbonator as would otherwise be the case if carbonator were supported in a non-horizontal orientation, so that the level control sensor 56 need only sense level differences over a relatively short distance.

Ice from the ice retaining bin 24 that drops through the cold plate cover opening 30 onto the heat exchange surface 34 of the cold plate 26 provides for cooling of the various beverage fluid conveying tubes embedded in the cold plate, as well as for cooling of the carbonator 44 through heat exchange contact of the cold plate saddle supports 46*a* and 46*b* with the carbonator. The positioning of the carbonator 44 along an edge of the cold plate 26 and the location of the supports 46*a* and 46*b* at corners of the cold plate serve to space the carbonator sufficiently far from the cold plate heat exchange surface 34 so as to minimize any diminution of the area of the heat exchange surface that ice can contact as a result of support of the carbonator by the cold plate, whereby the cooling efficiency of the cold plate is not degraded by virtue of the presence of the carbonator. It may be appreciated that the carbonator and cold plate combination is compact in both horizontal and vertical directions, thereby desirably providing for an efficient use of space. Moreover, the particular cold plate structure utilized in practice of the invention is relatively easy and inexpensive to mold as a unitary integral structure. If desired or required, the carbonator 44 could be held at an angle if the height of the support 46*a* were less than shown, in which case the carbonator 44 could approach or be retained at the same angle as is the cold plate 26. Should the carbonator 44 be held at an angle, the fluid contents thereof will flow by gravity to a "bottom" end of the carbonator adjacent the end cap 44*b*, so that a majority of the fluid contents of the carbonator will then be in close contact with the support 46*a*, thereby providing for enhanced heat exchange contact therewith. In this case, the support 46*a* could he increased in size so as to increase the contact area of its heat exchange surface 48 with the carbonator 44, and hence increase the heat exchange ability of its surface 48 in order to offset a possible concomitant reduction in the heat exchange ability of the surface 48 of the support 46*b*. Supporting the carbonator 44 on an incline would also allow utilization of a significant percentage of the internal volume thereof for containing carbonated water.

Those of skill will appreciate that various changes can be made to the present invention without exceeding the scope and spirit thereof. Thus, it will be apparent that the cold plate 26 could have a single carbonator support, or more than two carbonator supports, instead of the two supports 46*a* and 46*b*. Alternatively, carbonator supports could be provided on opposite edges of the cold plate instead of on just one edge, such that the carbonator would then span over and extend above and across the heat exchange surface 34 of the cold plate. It also is contemplated that depending upon the configuration of an external surface of a carbonator to be supported by the cold plate 26, the heat exchange surfaces 48 of the supports 46*a* and 46*b* can be formed to have other than the arcuate shape shown, thereby to enable to the surfaces 48 receive, support, conform to and uniformly contact supported surface portions of a variety of carbonators having other than cylindrical shaped exterior surfaces.

What is claimed is:

1. A beverage cooling system, comprising:

a cold plate for receiving ice and including integral support means for mounting a carbonator in heat exchange relationship with said cold plate and in spaced relationship from the remainder of said cold plate, such that mounting of the carbonator by said support means does not result in a substantial reduction in a surface area of said cold plate that is available to receive ice.

2. A beverage cooling system as in claim 1, wherein said cold plate has a heat exchange surface and said support means is for mounting the carbonator in spaced relationship from said heat exchange surface so that the carbonator does not reduce a surface area of said heat exchange surface that is available to receive ice.

3. A beverage cooling system as in claim 1, wherein said cold plate support means has a carbonator mounting surface that is vertically above the remainder of said cold plate for mounting the carbonator vertically above said cold plate.

4. A beverage cooling system as in claim 1, wherein said cold plate support means comprises a pair of integral vertically extending supports having upper surfaces for mounting the carbonator on said upper surfaces and above the remainder of said cold plate.

5. A beverage cooling system as in claim 1, wherein said cold plate has a heat exchange surface and said cold plate support means comprises at least two integral supports extending vertically upward from a perimeter of said heat exchange surface for mounting the carbonator on upper ends thereof with the carbonator in vertically spaced relationship from and above said heat exchange surface.

6. A beverage cooling system as in claim 5, wherein said upper ends of said supports are saddles that are complementary in shape to the shape of a carbonator to be mounted to provide intimate heat transfer contact with the carbonator.

7. A beverage cooling system as in claim 1, wherein said cold plate is angled downward to facilitate runoff of ice melt water from said cold plate and said support means is for mounting the carbonator in horizontal orientation.

8. A beverage cooling system as in claim 4, wherein said cold plate is angled downward to facilitate runoff of ice melt water from said cold plate and said pair of vertically extending supports mount the carbonator horizontally on said upper surfaces thereof.

9. A beverage cooling system as in claim 4, wherein said cold plate has a generally rectangular heat exchange surface having a perimeter and said pair of integral vertically extending supports are located along one side of said perimeter in horizontal spaced relationship.

10. A beverage cooling system as in claim 4, wherein said cold plate has a generally rectangular heat exchange surface having a perimeter and said pair of integral vertically extending supports are located on respective opposite sides of said perimeter.

11. A beverage cooling system, comprising:

a cold plate having a heat exchange surface for receiving ice, said heat exchange surface being defined within a perimeter of said cold plate and said cold plate further having integral support means extending upward from said perimeter and having upper surface means for mounting a carbonator tank in vertically spaced relationship from said cold plate heat exchange surface and in heat exchange contact with said upper surface means, whereby mounting the carbonator tank on said cold plate does not result in a substantial diminution of a surface area of said cold plate heat exchange surface that is available to receive and retain ice.

12. A beverage cooling system as in claim 11, wherein said support means comprises a pair of horizontally spaced integral supports extending vertically upward from said cold plate perimeter for mounting the carbonator tank on said upper surface means thereof, so that the carbonator tank extends between said integral supports in vertically spaced relationship from said cold plate heat exchange surface.

13. A beverage cooling system as in claim 12, wherein said cold plate heat exchange surface is generally rectangular and said horizontally spaced integral supports extend vertically upward from one side of said cold plate perimeter for mounting the carbonator tank on said upper surface means thereof in vertically spaced relationship from said one side of said perimeter.

14. A beverage cooling system as in claim 12, wherein said cold plate heat exchange surface is generally rectangular and said horizontally spaced integral supports extend vertically upward from opposite sides of said cold plate perimeter for mounting the carbonator tank on said upper surface means thereof in vertically spaced relationship from and above and across said heat exchange surface.

15. A beverage cooling system as in claim 12, wherein said upper surfaces of said integral supports are saddles for mounting a tubular carbonator tank and are configured to be complimentary in shape to supported surface areas of the carbonator tank for intimate heat exchange contact between said saddles and the carbonator surface areas.

16. A beverage cooling system as in claim 12, wherein said cold plate is angled downward to facilitate runoff of ice melt water from said heat exchange surface, and said horizontally spaced integral supports extend vertically above said cold plate perimeter by amounts selected so that said upper surface means of said supports mount the carbonator tank in generally horizontal orientation.

17. A beverage cooling system, comprising:

a cold plate for receiving ice on surfaces thereof, said cold plate including integral support means having support surface means; and a carbonator mounted in heat exchange relationship with and on said cold plate support surface means, said support surface means mounting said carbonator in spaced relationship from the remainder of said cold plate surfaces, so that mounting said carbonator on said cold plate does not result in a substantial diminution of areas of said cold plate surfaces that are available to receive ice.

18. A beverage cooling system as in claim 17, wherein said cold plate has a heat exchange surface and said support surface means mounts said carbonator in spaced relationship from said heat exchange surface, so that mounting of said carbonator on said cold plate does not diminish an area of said heat exchange surface that is available to receive ice.

19. A beverage cooling system as in claim 17, wherein said cold plate support surface means is vertically above the remainder of said cold plate for mounting said carbonator vertically above said cold plate.

20. A beverage cooling system as in claim 17, wherein said cold plate support means comprises a pair of integral horizontally spaced and vertically extending supports having upper support surfaces for supporting said carbonator on said support surfaces and above the remainder of said cold plate.

21. A beverage cooling system as in claim 17, wherein said cold plate has a heat exchange surface and said cold plate support means comprises at least two horizontally spaced integral supports extending vertically upward from a perimeter of said heat exchange surface and having upper support surfaces for mounting said carbonator vertically spaced above said heat exchange surface.

22. A beverage cooling system as in claim 21, wherein said heat exchange surface is generally rectangular and said at least two supports extend vertically upward from one side of said perimeter of said heat exchange surface.

23. A beverage cooling system as in claim 21, wherein said primary heat exchange surface is generally rectangular and said at least two supports comprise two supports that extend vertically upward from opposite sides of said perimeter of said heat exchange surface.

24. A beverage cooling system as in claim 20, wherein said upper surfaces of said supports are saddles that are complementary in shape to a shape of said carbonator to provide intimate heat transfer contact between said support surfaces and said carbonator.

25. A beverage cooling system as in claim 17, wherein said cold plate is angled downward to facilitate runoff of ice melt water from said cold plate and said support means mounts said carbonator in horizontal orientation.

26. A beverage cooling system as in claim 20, wherein said cold plate is angled downward to facilitate runoff of ice melt water from said cold plate and said pair of vertically extending supports mount said carbonator horizontally on said upper support surfaces thereof.

* * * * *